United States Patent [19]

Yokoe et al.

[11] Patent Number: 4,526,567

[45] Date of Patent: Jul. 2, 1985

[54] APPARATUS FOR MANUFACTURING PAPER STRINGER TAPE FOR SLIDE FASTENER

[75] Inventors: Kazuo Yokoe; Yukio Sekine, both of Kurobe, Japan

[73] Assignee: Yoshida Kogyo K. K., Tokyo, Japan

[21] Appl. No.: 382,786

[22] Filed: May 27, 1982

[30] Foreign Application Priority Data

May 28, 1981 [JP] Japan ..... 56-78710

[51] Int. Cl.[3] ..... B31F 1/18

[52] U.S. Cl. ..... 493/381; 83/698; 493/399; 493/439

[58] Field of Search ..... 493/397, 398, 399, 402, 493/403, 438, 439, 440, 443; 29/766, 767, 768, 769, 408, 409, 410, 33.2; 223/34; 112/147; 83/879, 886, 698, 107, 102; 226/190, 191; 225/98, 99

[56] References Cited

U.S. PATENT DOCUMENTS

| | | | |
|---|---|---|---|
| 678,100 | 7/1901 | Colpitts | 493/399 X |
| 2,126,138 | 8/1938 | Riese | 493/399 |
| 2,562,454 | 7/1951 | Grant | 493/399 |
| 2,772,088 | 11/1956 | Nelson | 493/399 |
| 3,848,435 | 11/1974 | Armstrong | 112/147 X |
| 3,880,057 | 4/1975 | Hollier | 493/440 |

*Primary Examiner*—John Sipos
*Assistant Examiner*—Donald R. Studebaker
*Attorney, Agent, or Firm*—Hill, Van Santen, Steadman & Simpson

[57] ABSTRACT

A method of and apparatus for manufacturing a pair of paper stringer tapes for slide fasteners from a pair of blank paper strips of a continuous length. The blank paper strips are fed lengthwise through a guide roller assembly. A pair of parallel spaced scoring wheels is biased against one guide roller of the guide roller assembly. As the paper strips pass between the one guide roller and the respective scoring wheels, a pair of continuous prospective folding lines of a constant depth is formed on the blank paper strips along the respective inner longitudinal margin thereof. The inner longitudinal margin of each paper strip is folded on the folding line to provide a doubled thickness with a folded edge on which a row of thermoplastic coupling elements is to be mounted. The support of the scoring wheels enables them to move toward and away from the strip, either jointly or individually, to compensate for variations in paper thickness, whereby said constant depth is maintained.

2 Claims, 9 Drawing Figures

APPARATUS FOR MANUFACTURING PAPER STRINGER TAPE FOR SLIDE FASTENER

BACKGROUND OF THE INVENTION

1. Field of the Invention

The present invention relates generally to the production of slide fasteners, and more particularly to an apparatus for manufacturing a paper stringer tape for slide fasteners.

2. Prior Art

In the manufacture of a slide fastener having a pair of paper stringer tapes, it is a common practice to score a continuous folding line on a blank paper strip along one longitudinal margin thereof and to then fold the paper strip about the score line to provide a folded edge on which a row of thermoplastic coupling elements is to be mounted. The problem is that the scoring line varies in depth due to local thickness change of the paper strip. With this varying depth of the scoring line, it is possible to fold the paper strip only incompletely, i.e. with an elongate gap or space within the folded edge along the folding line, causing unstable and irregular attachment of the coupling elements to the folded edge.

SUMMARY OF THE INVENTION

It is an object of the present invention to provide an apparatus for manufacturing a paper stringer tape for slide fasteners, in which a prospective folding line of a constant depth can be scored on a blank paper strip along the full length thereof, irrespective of any variation in paper thickness.

Another object of the invention is to provide an apparatus for manufacturing a paper stringer tape for slide fasteners, in which a blank paper strip can be folded completely with no gap or space within a folded edge, enabling stable and regular attachment of the coupling elements to the folded edge.

According to the present invention, a pair of blank paper strips of a continuous length is fed longitudinally through a guide roller assembly. A pair of parallel spaced scoring wheels is spring-biased against one guide roller of the guide roller assembly. As the paper strips pass between the one guide roller and the respective scoring wheels, a pair of continuous prospective folding lines of a constant depth is scored on the blank paper strips along the respective inner longitudinal margin thereof. The inner longitudinal margin of each paper strip is folded on the score line to provide a folded edge on which a row of thermoplastic coupling elements is to be mounted.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
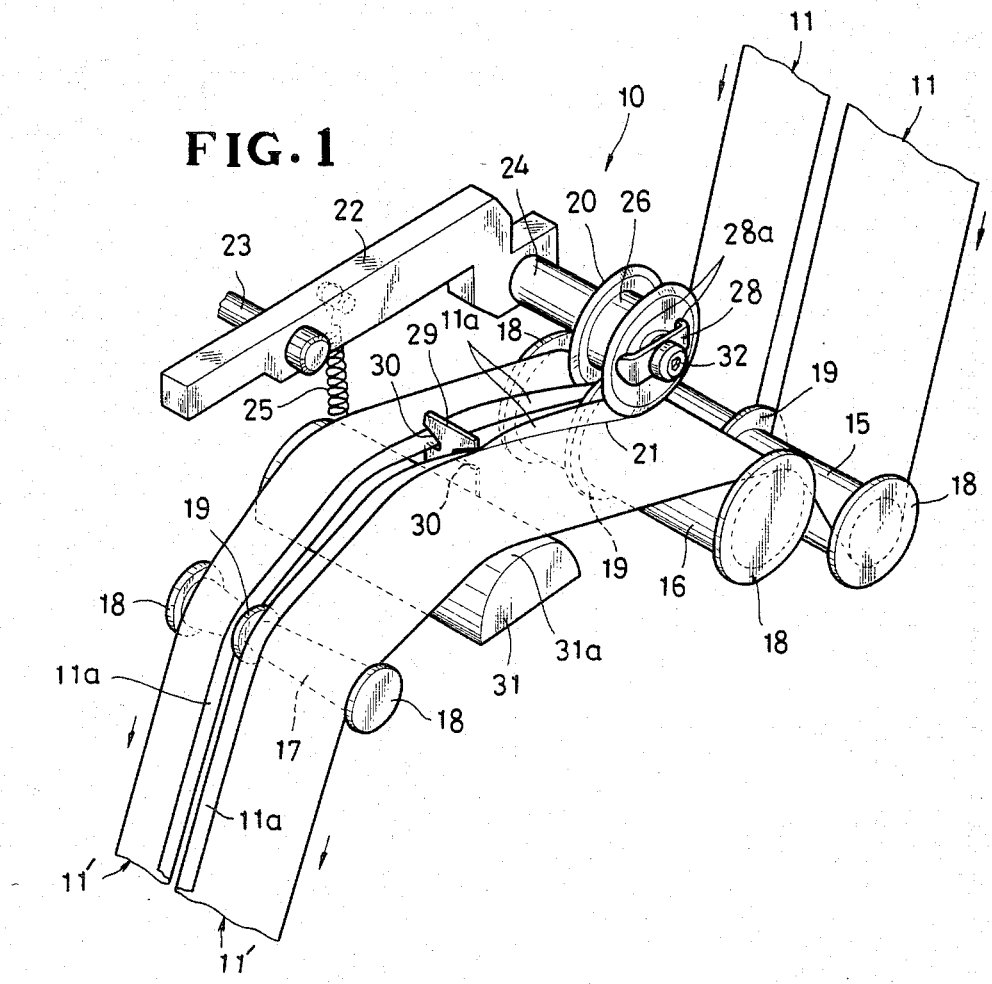
FIG. 1 is a fragmentary perspective view of an apparatus according to the present invention.
Figure 2:
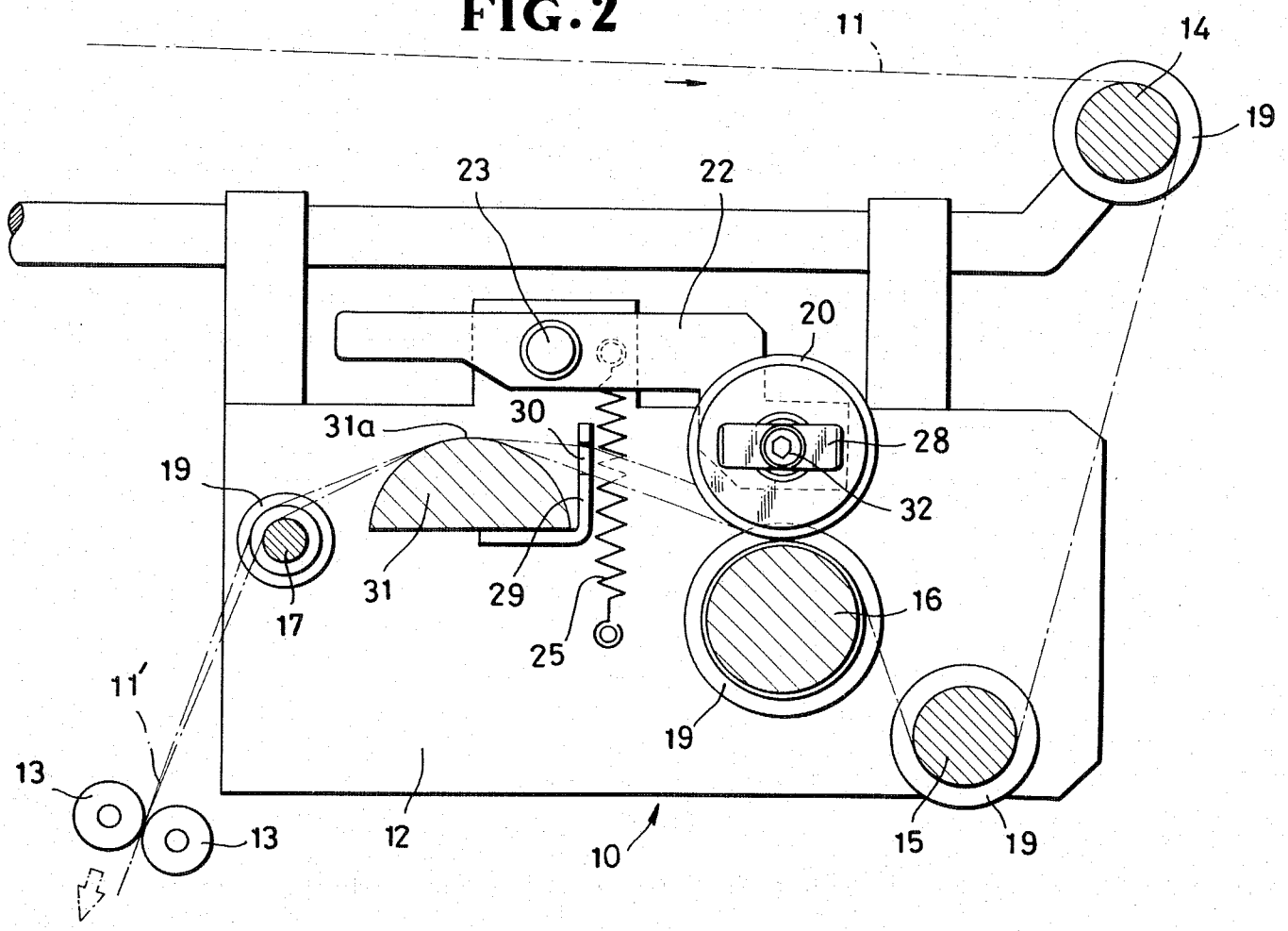
FIG. 2 is a side elevational view, partly in cross section, of the apparatus shown in FIG. 1.
Figure 3:
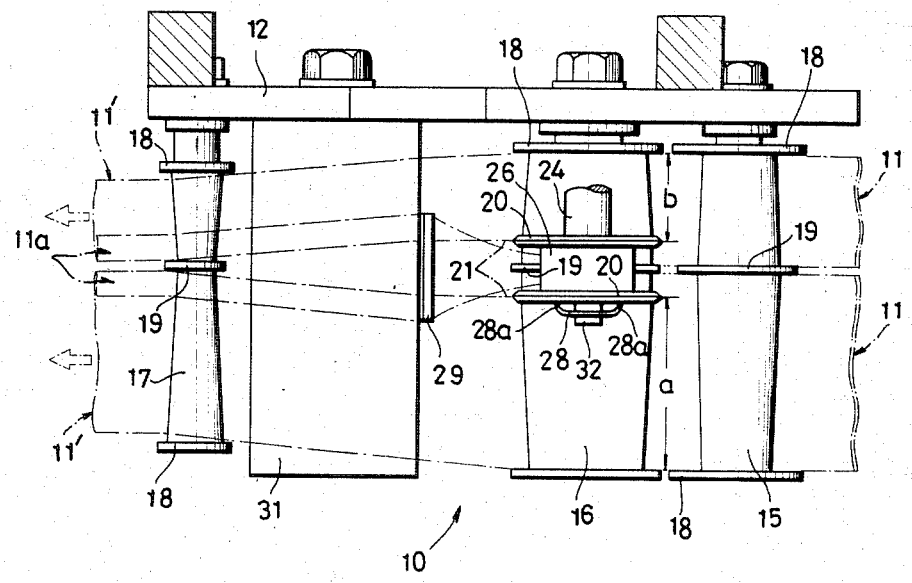
FIG. 3 is a plan view, partly in cross section, corresponding to FIG. 2.

FIGS. 1 through 3 show an apparatus 10 for manufacturing a pair of paper stringer tapes 11',11' for slide fasteners from a pair of blank paper strips 11,11 of a continuous length.

The apparatus 10 comprises a guide roller assembly (described below) supported by a frame 12 for guiding the blank paper strips 11,11 in parallel spaced relation to one another, and a pair of feed rollers 13,13 for feeding the blank paper strips 11,11 longitudinally thereof through the guide roller assembly. The guide roller assembly includes first, second, third and fourth guide rollers 14,15,16,17 disposed in parallel spaced relation to one another along the traveling path of the paper strips 11,11. Each guide roller 14,15,16,17 has a pair of outer flanges 18,18 and an intermediate flange 19. As the paper strips 11,11 travel through the guide roller assembly, as better shown in FIG. 2, they pass over the first guide roller 14 at the uppermost level, then under the second guide roller 15 at the lowermost level, thence over the third guide roller 16 disposed to the upper left of and near the second guide roller 15, and finally over the fourth guide roller 17 via a paper folding means 29,31 (described below). The folding means 29,31 is disposed to the upper left of and near the third guide roller 16, and the fourth guide roller 17 is disposed to the lower left of and near the folding means 29, 31.

Figure 6:
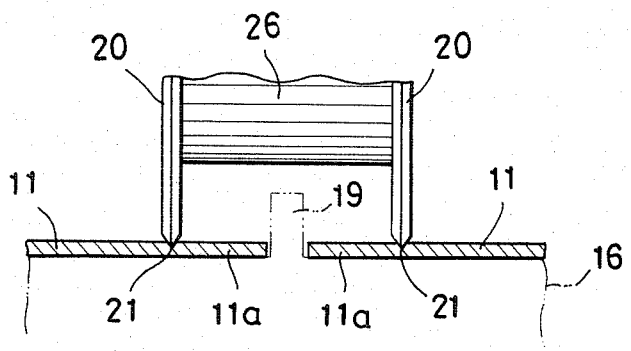
FIGS. 6 through 8 are enlarged, fragmentary transverse cross-sectional views of a pair of blank paper strips, illustrating the manner in which each blank paper strip is processed into a paper stringer tape for slide fasteners.

The apparatus 10 further comprises a pair of parallel spaced scoring wheels 20,20 normally urged against the third guide roller 16 for scoring a pair of continuous prospective folding lines 21,21, one on each blank paper strip 11 along one or an inner longitudinal margin **11*a* thereof while the blank paper srips 11,11 are passed between the third guide roller 16 and the respective scoring wheels 20,20, as shown in FIG. 6. A lever 22 is pivotally mounted on the frame 12 by means of a pin 23 and has a first shaft 24 projecting, as a cantilever, from one end of the lever 22 in parallel relation to the third guide roller 16. The lever 22 is normally biased, by means of gravity and a spring 25, to pivot clockwise in FIG. 2, thus urging the first shaft 24 toward the third guide roller 16. The scoring wheels 20,20 are formed integrally with a hollow second shaft 26 at opposite ends, the hollow second shaft 26 being rockably supported by a spherical bearing 27 mounted on the first shaft 24**.

Figure 5:
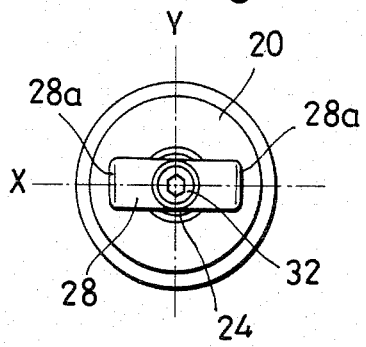
FIG. 5 is a side elevational view of the scoring wheels of FIG. 4.

A horizontal stop plate 28 is mounted on the first shaft 24 by means of a screw 32 and extends diametrically thereof. The stop plate 28 has a pair of inwardly directed ends **28*a*,28*a* touching one scoring wheel 20 on the outer face thereof. By means of the stop plate 28, the second shaft 26 is prevented from being rocked or horizontally inclined with respect to the first shaft 24 i.e. in the direction of coordinate axis X (FIG. 5); at the same time the second shaft 26 is allowed to be rocked or vertically inclined with respect to the first shaft 24, i.e. in the direction of coordinate axis Y (FIG. 5**).

Figure 7:
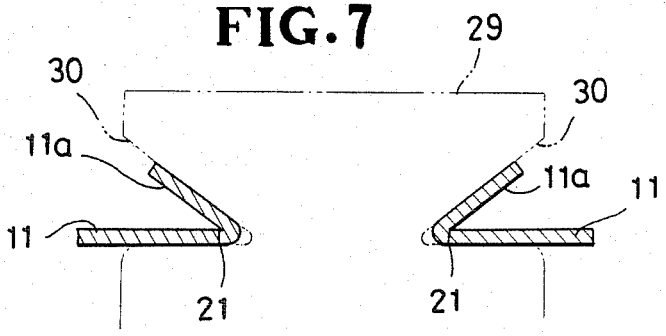
Figure 8:
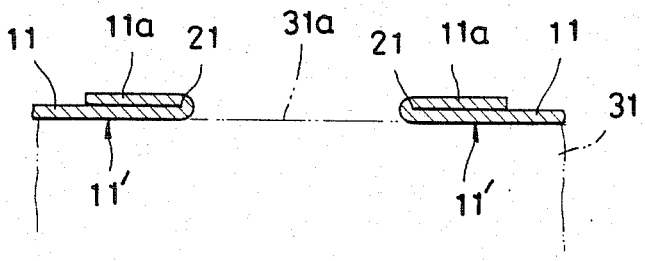

Disposed downstream of the third guide roller 16 is a vertical prefolding plate 29 having a pair of V-shaped cutouts 30,30 on opposite sides for prefolding the paper strips 11,11 about the score lines 21,21, as the paper strips 11,11 are moved through the V-shaped cutouts 30,30 respectively, until the inner longitudinal margin 11*a* of each paper strip 11 lies at an acute angle with respect to the general plane of the paper strip 11, as shown in FIG. 7. The prefolding plate 29 is supported by a semi-cylindrical folding block 31 extending, as a cantilever, from the frame 12 in parallel relation to the guide rollers 14,15, 16,17 for folding the prefolded paper strips 11,11 completely, as the latter are moved past around such curved surface 31*a* of the folding block 31, until the inner longitudinal margin 11*a* of each paper strip 11 lies flat on the general plane of the paper strip 11, as shown in FIG. 8.

As best shown in FIG. 3, each of the second and third guide rollers 15,16 increases in diameter from the opposite outer flanges 18,18 toward the intermediate flange 19 in order that each of the score lines 21,21 is spaced from the outer edges of the paper strips 11,11 by constant distances a, b, respectively, along the full length of the paper strips 11,11. With this arrangement, any variation in the width of either strip 11 will be transferred to the margin 11*a*. The fourth guide roller 17 increases in diameter from the intermediate flange 19 toward the opposite outer flanges 18,18 in order that the paper strips 11,11, each folded into a finished paper stringer tape 11',11', are moved toward one another.

In operation, as a pair of blank paper strips 11,11 is fed through the guide roller assembly in the direction indicated by unnumbered arrows (FIGS. 1–3), they travel over the first guide roller 14, under the second guide roller 15, and then between the third guide roller 16 and the respective scoring wheels 20,20. The scoring wheels 20,20 roll on the respective paper strips 11,11, in response to the feeding thereof, and score a pair of continuous prospective folding lines 21,21, one on each paper strip 11 along the inner longitudinal margin 11*a* thereof, as shown in FIG. 6.

Figure 4:
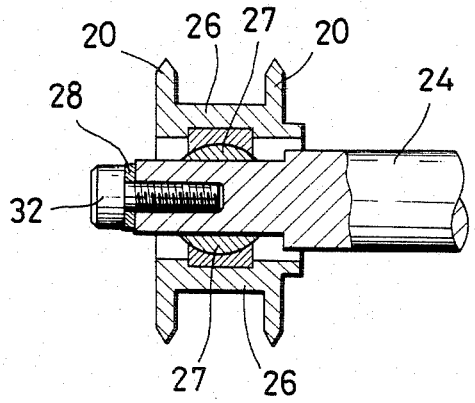
FIG. 4 is a vertical fragmentary cross-sectional view of a pair of scoring wheels.

During the scoring, if there is a local thickness change of either blank paper strip 11 at the inner longitudinal margin 11*a* where a prospective folding line 21 is being scored, one or both of the scoring wheels 20,20 will move vertically by an amount depending on the local thickness variation of the blank paper strips 11,11. This is true because the scoring wheels 20,20 are jointly supported by the lever 22 that is spring-biased as shown in FIGS. 1 and 2. Furthermore, because of the spherical bearing 27 (FIG. 4) and the horizontal stop plate 28 (FIGS. 1–5), the common second shaft 26 of the scoring wheels 20,20 is allowed to be inclined with respect to the first shaft 24 only in a vertical plane i.e. in the direction of coordinate axis Y (FIG. 5); at the same time the second shaft 26 is prevented from being inclined with respect to the first shaft 24 horizontally, i.e. in the direction of coordinate axis X (FIG. 5). With this arrangement, it is possible to engrave a pair of continuous prospective folding lines 21,21 having a constant depth along the full length of the paper strips 11,11, irrespective of any local thickness change. This constant depth enables easy and proper folding of the paper strips 11,11, producing high quality paper stringer tapes 11',11' for slide fasteners.

With continued feeding of the paper strips 11,11, they travel around the curved surface 31*a* of the semicylindrical prefolding block 31 via the respective V-shaped cutouts 30,30 of the prefolding plate 29. As the paper strips 11,11 are moved through the V-shaped cutouts 30,30, they are prefolded or bent about the respective score lines 21,21 until the inner longitudinal margin 11*a* of each paper strip 11 lies at an acute angle with respect to the general plane of the paper strip 11, as shown in FIG. 7.

Figure 9:
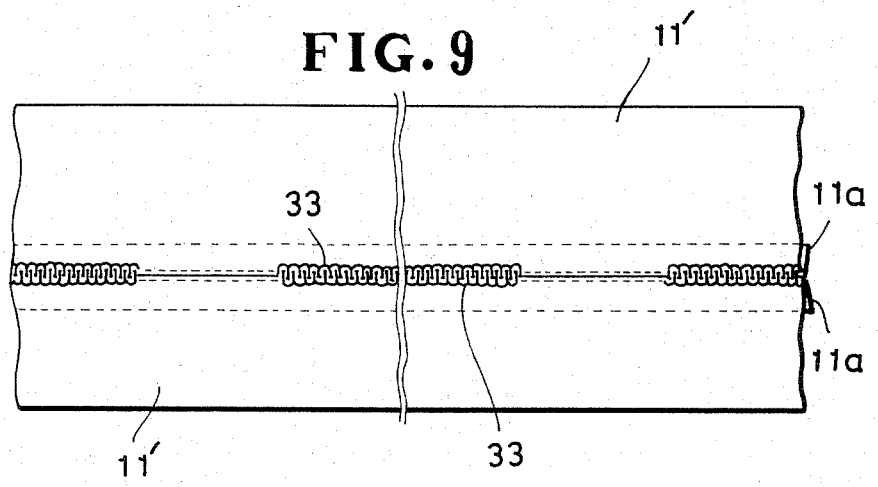
FIG. 9, appearing with FIG. 4, is a fragmentary plan view of a pair of continuous slide fastener stringers each having a paper stringer tape manufactured according to the present invention.

Finally, the prefolded paper strips 11,11 are folded completely, as they pass around the curved surface 31*a* of the folding block 31, until the inner longitudinal margin 11*a* of each paper strip 11 lies flat on the general plane of the paper strip 11, as shown in FIG. 8. The folded paper strips 11',11' are discharged out of the apparatus 10 via the fourth guide roller 17, at which time the finished paper strips 11',11' move close to each other because the fourth guide roller 17 increases in diameter from the intermediate flange 19 toward the outer flanges 18,18. Thus a pair of continuous paper stringer tapes 11',11' has been provided, each tape 11' having a margin of doubled thickness with a folded inner edge on which a row of thermoplastic coupling elements 33 (FIG. 9) is to be mounted by a suitable means, e.g. sewing stitches (not shown).

Although various minor modifications may be suggested by those versed in the art, it should be understood that we wish to embody within the scope of the patent warranted hereon all such embodiments as reasonably and properly come within the scope of our contribution to the art.

What is claimed is:

1. An apparatus for manufacturing a pair of paper stringer tapes for slide fasteners from a pair of blank paper strips of a continuous length, comprising;

(a) a frame;

(b) a guide roller assembly supported by said frame;

(c) means for feeding the pair of blank paper strips length-wise through said guide roller assembly;

(d) a pair of parallel spaced scoring wheels normally urged toward one guide roller of said guide roller assembly for scoring a pair of continuous prospective fold lines of a consant depth, one on each blank paper strip, along one longitudinal margin thereof while the blank strips are passed between said one guide roller and the respective scoring wheels;

(e) means disposed downstream of said one guide roller for folding said one longitudinal margin of each paper strip on said folding line, while the scored paper is moved past said folding means, to provide a margin of double thickness with a folded edge on which a row of coupling elements for slide fasteners is to be mounted;

(f) a lever pivotally mounted on said frame;

(g) a first shaft projecting from one end of said lever in parallel to said one guide roller;

(h) means biasing said lever to pivot so as to urge said first shaft toward said one guide roller;

(i) a spherical bearing mounted on said first shaft;

(j) a hollow second shaft extending between said scoring wheels and supported by said spherical bearing; and (k) a stop plate mounted on said first shaft and extending horizontally and diametrically thereof for preventing said second shaft from rocking horizontally with respect to said first shaft and for allowing said second shaft to be rocked vertically with respect to said first shaft.

2. An apparatus for manufacturing a pair of paper stringer tapes for slide fasteners from a pair of blank paper strips of a continuous length, comprising:

(a) a frame;

(b) a guide roller assembly supported by said frame;

(c) means for feeding the pair of blank paper strips lengthwise in horizontally spaced relation to each other through said guide assembly;

(d) a pair of parallel spaced scoring wheels normally urged toward one guide roller of said guide roller assembly for scoring a pair of continuous prospective folding lines of a constant depth, one on each blank paper strip, immediately adjacent longitudinal margins of the spaced strips while the blank paper strips are passed between said one guide roller and the respective scoring wheels, said one guide roller having a pair of outer flanges, the diameter of said one guide roller increasing from said outer flanges enabling said paper strips to engage said flanges, by which the distance from the outer edge of the strip to the prospective score line is held constant in spite of any variation in the width of the paper strip; and (e) means disposed downstream of said one guide roller and having a portion for projecting between the spaced strips and for folding one longitudinal margin of each paper strip on said folding line while the scored paper strip is moved past said folding means to provide spaced single margins of double thickness, each having a folded edge confronting the other folded edge on each of which a row of interengagable coupling elements for slide fasteners is to be mounted.

* * * * *